US009687850B2

(12) United States Patent
Giusti

(10) Patent No.: US 9,687,850 B2
(45) **Date of Patent: *Jun. 27, 2017**

(54) FLIP TOP CAP WITH CONTAMINATION PROTECTION

(71) Applicant: CORNING INCORPORATED, Corning, NY (US)

(72) Inventor: David C. Giusti, Somerville, MA (US)

(73) Assignee: Corning Incorporated, Corning, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/099,216

(22) Filed: Apr. 14, 2016

(65) Prior Publication Data

US 2016/0228872 A1 Aug. 11, 2016

Related U.S. Application Data

(63) Continuation of application No. 14/518,303, filed on Oct. 20, 2014, now Pat. No. 9,352,318, which is a continuation of application No. 13/447,690, filed on Apr. 16, 2012, now Pat. No. 8,863,968, which is a continuation of application No. 11/177,728, filed on Jul. 8, 2005, now Pat. No. 8,172,101.

(60) Provisional application No. 60/587,459, filed on Jul. 13, 2004.

(51) Int. Cl.
*B65D 35/44* (2006.01)
*B01L 3/00* (2006.01)

(52) U.S. Cl.
CPC ..... *B01L 3/50825* (2013.01); *B01L 2200/141* (2013.01); *B01L 2300/042* (2013.01); *B01L 2300/043* (2013.01); *B01L 2300/0848* (2013.01); *B01L 2300/0858* (2013.01)

(58) Field of Classification Search
CPC ..... B01L 3/50825; B01L 2300/043; B01L 2300/141; B01L 2300/042; B01L 2300/0848; B01L 2300/0858
USPC ..... 215/305, 307, 235, 237; 220/254.4, 220/254.8, 255, 288, 366.1, 785, 790, 220/802, 810; 222/556
See application file for complete search history.

(56) References Cited

U.S. PATENT DOCUMENTS

| | | | |
|---|---|---|---|
| 2,630,139 | A | 3/1953 | Paull et al. |
| 3,085,705 | A | 4/1963 | Varney |
| 3,295,726 | A | 1/1967 | Hanson |
| 4,420,089 | A | 12/1983 | Walker et al. |
| 4,713,219 | A | 12/1987 | Gerken et al. |
| 4,773,559 | A | 9/1988 | Sasaki et al. |
| 5,139,165 | A | 8/1992 | Hara |
| 5,141,138 | A | 8/1992 | Odet et al. |
| 5,200,153 | A | 4/1993 | Carr et al. |
| 5,254,314 | A | 10/1993 | Yu et al. |

(Continued)

*Primary Examiner* — Fenn Mathew
*Assistant Examiner* — Elizabeth Volz
(74) *Attorney, Agent, or Firm* — John P. Ciccarelli

(57) ABSTRACT

A cap is provided for a laboratory vessel. The cap includes a lid that can be rotated relative to the laboratory vessel from a closed position to an open position. The lid includes at least one tab dimensioned and disposed for receiving manual digital pressure for opening and/or closing the lid. The tab is in an offset position to prevent a thumb or forefinger from passing over and in contact with the opening to the vessel. Additionally, the lid includes a shield inwardly from the tab for further preventing contact between a finger and the open top of the vessel.

15 Claims, 4 Drawing Sheets

(56) References Cited

U.S. PATENT DOCUMENTS

| | | | | |
|---|---|---|---|---|
| 5,398,837 | A | 3/1995 | Degrassi | |
| 5,509,564 | A | 4/1996 | Knoop | |
| 5,531,349 | A | 7/1996 | Wojcik et al. | |
| 5,547,091 | A | 8/1996 | Neveras et al. | |
| 5,547,109 | A | 8/1996 | Robbins, III | |
| 5,667,094 | A | 9/1997 | Rapchak et al. | |
| 5,755,352 | A | 5/1998 | Wojcik et al. | |
| 5,860,543 | A | 1/1999 | Decelles | |
| 5,865,354 | A | 2/1999 | Bansal | |
| 5,871,111 | A | 2/1999 | Pfefferkorn et al. | |
| 5,884,793 | A | 3/1999 | Wang | |
| 6,145,688 | A | 11/2000 | Smith | |
| 6,170,719 | B1 | 1/2001 | Wilkinson et al. | |
| 6,283,298 | B1 | 9/2001 | Seidler | |
| 6,350,254 | B1 | 2/2002 | Wilkinson et al. | |
| 6,352,171 | B2 | 3/2002 | Leboucher | |
| 6,375,028 | B1 | 4/2002 | Smith | |
| 6,439,410 | B1 | 8/2002 | Dubach | |
| 6,841,132 | B2 | 1/2005 | Samsoondar | |
| 6,866,826 | B2 | 3/2005 | Moore et al. | |
| 6,890,488 | B2 | 5/2005 | Mathus et al. | |
| 6,932,942 | B2 | 8/2005 | Itoh | |
| 7,007,830 | B2 | 3/2006 | Parve et al. | |
| 8,172,101 | B2 | 5/2012 | Giusti | |
| 8,863,968 | B2 | 10/2014 | Giusti | |
| 9,352,318 | B2 * | 5/2016 | Giusti | B01L 3/50825 |
| 2002/0130100 | A1 | 9/2002 | Smith | |
| 2003/0136783 | A1 | 7/2003 | Hatsumoto et al. | |
| 2004/0089627 | A1 | 5/2004 | Smith et al. | |
| 2005/0242105 | A1 | 11/2005 | Homann | |
| 2005/0247714 | A1 | 11/2005 | Backes et al. | |
| 2006/0000833 | A1 | 1/2006 | Boots | |
| 2006/0024205 | A1 | 2/2006 | Giusti | |
| 2007/0009390 | A1 | 1/2007 | Giusti | |

* cited by examiner

FLIP TOP CAP WITH CONTAMINATION PROTECTION

CROSS-REFERENCES TO RELATED APPLICATIONS

This Application is a continuation of U.S. patent application Ser. No. 14/518,303, filed Oct. 20, 2014, now allowed, which is a continuation of U.S. application Ser. No. 13/447,690, filed Apr. 16, 2012, now U.S. Pat. No. 8,863,968, which is a continuation of U.S. application Ser. No. 11/177,728, filed Jul. 8, 2005, now U.S. Pat. No. 8,172,101, which claims priority to U.S. Provisional Application No. 60/587,459, filed Jul. 13, 2004, the entire contents of which are incorporated by reference herein.

BACKGROUND OF THE INVENTION

1. Field of the Invention

The invention relates to a flip top cap for use with laboratory vessels, such as tubes.

2. Description of the Related Art

Many laboratory procedures require tissue cultures or cell cultures to be stored and/or cultivated in a vessel, such as a tube or a flask. The typical tube includes a cylindrical side wall, a closed bottom and an open top. The closed bottom often is conically generated. The size of the tube varies from one laboratory procedure to another, and tubes typically will define volumes from 15 mL to 50 mL. Flasks also have a side wall, a closed bottom and an open top. For simplicity, the following discussion will describe tubes, but pertains to other laboratory vessels as well.

Many laboratory procedures require the tissue or cell cultures in the tube to remain sterile. Thus, the tube typically is provided with a cap for sealing the open top of the tube. However, the cap must be removed periodically to access the tissue or cell cultures in the tube.

Many caps are formed separate from the tube and have a portion dimensioned for telescoping partly into the tube and sealing with the inner surface of the side wall adjacent the open top of the tube. These caps may be formed from an elastomer or other resilient material to ensure sealing with the tube. Other caps include a substantially rigid collar surrounding portions of the cap that telescope into the tube. The collar can be telescoped over the open top of the tube and provides a region that can be gripped conveniently for removing the cap from the tube.

Laboratory workers generally place the cap top-down on a laboratory work surface while they are accessing the interior of the tube with a pipette to obtain a sample of the cell or tissue culture in the tube. Thus, the side and bottom of the cap do not contact the potentially non-sterile work surface. The cap then is repositioned in sealing engagement with the open top of the tube after the cell or tissue culture has been accessed. These tube and cap combinations require the laboratory worker to use two hands to remove the cap. Additionally, these tube and cap combinations create the potential that the cap will be positioned improperly on the work surface, thereby creating the potential for contaminants being transferred from the work surface to the tissue or cell culture in the tube.

Some tubes have been manufactured with a flip cap to permit one-handed opening and to avoid the need to place any part of the cap on a laboratory work surface while the interior of the tube is being accessed by a pipette. These tube and cap assemblies typically include a body that is threaded or otherwise mounted to the open top of the tube. A cap is connected to the body by a hinge, such as a living hinge. A laboratory worker holds the tube between the forefingers and the palm of one hand. The thumb of the same hand then is urged against the cap to move the cap out of engagement with the body so that the cell or tissue culture in the tube can be accessed. These flip top caps provide certain handling efficiencies and avoid the need to place the cap on the work surface in the laboratory while the contents of the tube are being sampled. However, prior art flip top caps require the user's thumb to pass directly over the open top of the tube. There is a high probability that the user's thumb will contact the open top of the tube while the cap is being rotated away from the open top of the tube. Contact of the thumb with the open top of the tube is likely to contaminate the tube and the tissue or cell cultures stored therein.

In view of the above, it is an object of the subject invention to provide a tissue culture vessel, such as a tube, that can be opened easily without significant risk of contamination to the contents of the vessel.

SUMMARY OF THE INVENTION

The invention is a cap for a laboratory vessel, such as a tube. The vessel includes an open top, and the cap includes a lid that is hingedly secured in proximity to the open top of the vessel. Thus, the lid can be rotated hingedly from a closed position where the top of the vessel is closed and an open position where the top of the vessel is open. The open position is angularly spaced from the closed position by at least 90° and preferably about 180°.

The lid of the cap may be joined to a body and the body may be mounted to the open top of the vessel. For example, the vessel may include an array of threads, and the body may include an array of mating threads for securely mounting the body to the vessel. The body and the lid may be joined unitarily to one another by a living hinge. The living hinge may be an over-center hinge that is biased towards a fully closed position and/or a fully opened position. Thus, the over-center hinge will assist complete opening and/or complete closing of the lid.

The cap includes at least one tab, and preferably two tabs extending outwardly from the lid. The tab preferably is offset from a line that passes perpendicular to the rotational axis of the hinge at a location centrally along the hinge. The offset positioning of the tab offsets the thumb or forefinger of the user from the open top of the vessel, and hence reduces the possibility of contact with the open top of the vessel. Hence, the potential for contamination of cell or tissue cultures in the vessel is reduced.

The lid preferably includes a shield disposed to at least partly surround the open top of the vessel when the lid is in the closed position. The shield is at a side of the lid opposite the hinged connection and preferably extends along portions of the lid that have the tab. More particularly, the shield is disposed inwardly from the tab, and hence between the tab and the vessel. Accordingly, the shield cooperates with the tab to prevent contact with the open top of the vessel as the lid is being opened by a thumb or forefinger. The shield also prevents contact with portions of the lid that seal the open top.

The lid may further include a skirt dimensioned to telescope into the open top of the vessel or into the open top of the body mounted to the vessel. The skirt is dimensioned for sealed engagement with the open top of the vessel or with the body to achieve sterile containment of cell or tissue cultures in the vessel. Outer circumferential portions of the skirt may include anti-splash features, such as notches. The notches or other such anti-splash features balance air pressure between the inside and the outside of the vessel during the initial stage of opening the lid, and hence reduce the possibility of spraying or splashing as the lid is opened. The shield and the tab are disposed to prevent inadvertent contact with the skirt while the lid is being opened.

BRIEF DESCRIPTIONS OF THE DRAWINGS

DETAILED DESCRIPTION

Figure 5:
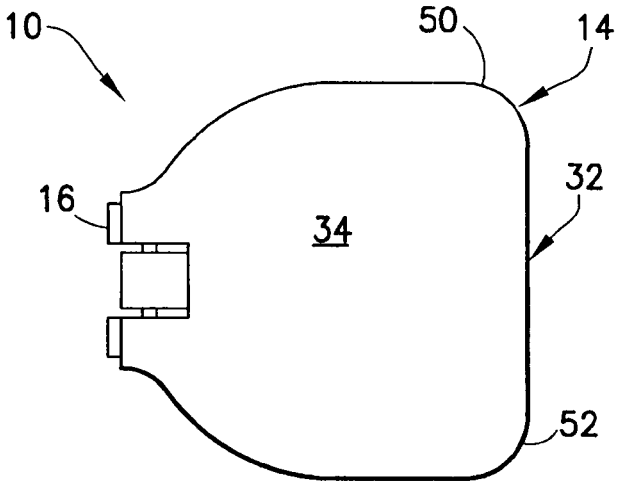
FIG. 5 is a top plan view of the cap in the closed position.
Figure 6:
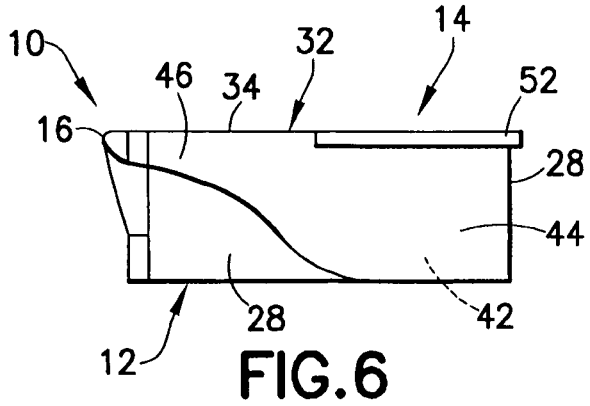
FIG. 6 is a side elevational view of the cap in the closed position.

A cap in accordance with the invention is identified generally by the numeral 10 in FIGS. 1-10. Cap 10 is molded unitarily from resin and includes a body 12 and a lid 14 that are joined unitarily by a living hinge 16. Hinge 16 enables lid 14 to be rotated approximately 180° between a fully open position, as shown in FIGS. 1-4, and a fully closed position, as shown in FIGS. 5 and 6. Additionally, hinge 16 has an over-center design configured to bias lid 14 through the final stages of rotation towards the open position of FIGS. 1-4 and towards the final stages of rotation towards the closed open position of FIGS. 5 and 6.

Body 12 includes a generally planar top wall 18 with a circular outer periphery 20 and a circular opening 22 concentric with outer periphery 20. A short cylindrical inner wall 24 extends down from top wall 18 concentrically with circular opening 22 in top wall 22. Thus, circular opening 22 and inner wall 24 define a short cylindrical sealing surface 26 facing inwardly on body 12.

Figure 1:
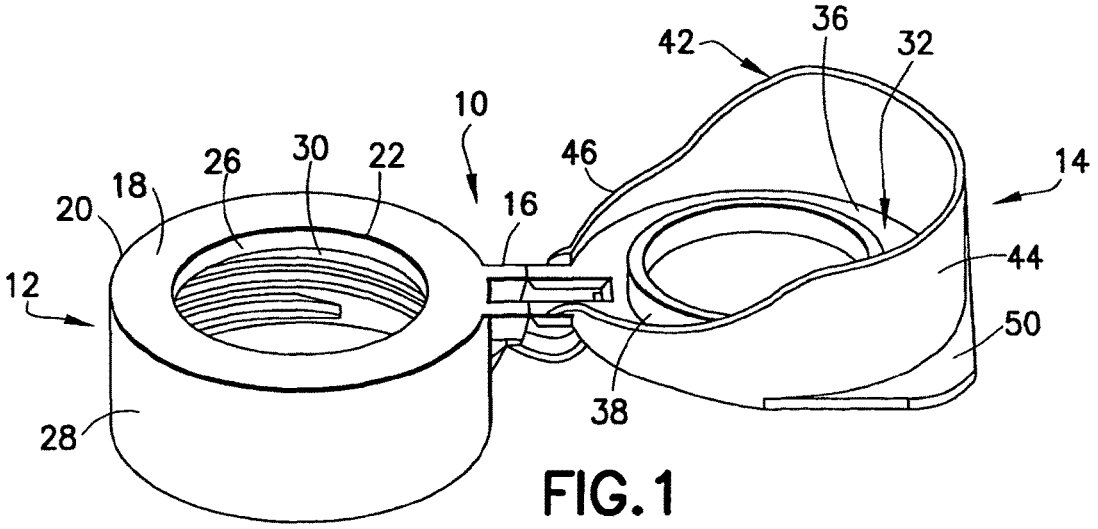
FIG. 1 is a perspective view of a cap in accordance with the invention.
Figure 3:
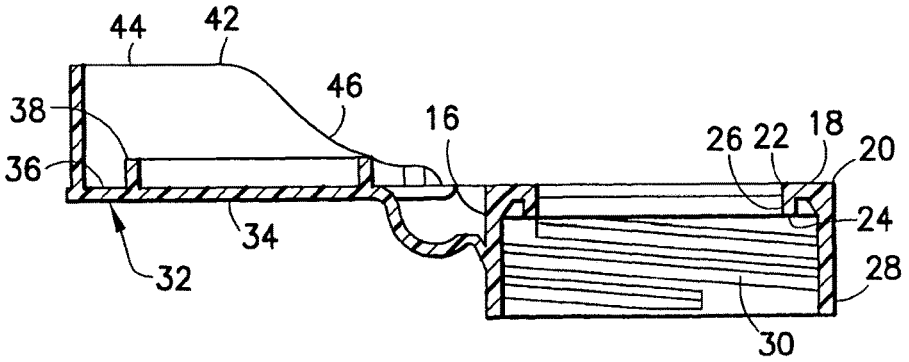
FIG. 3 is a cross-sectional view of the cap.
Figure 4:
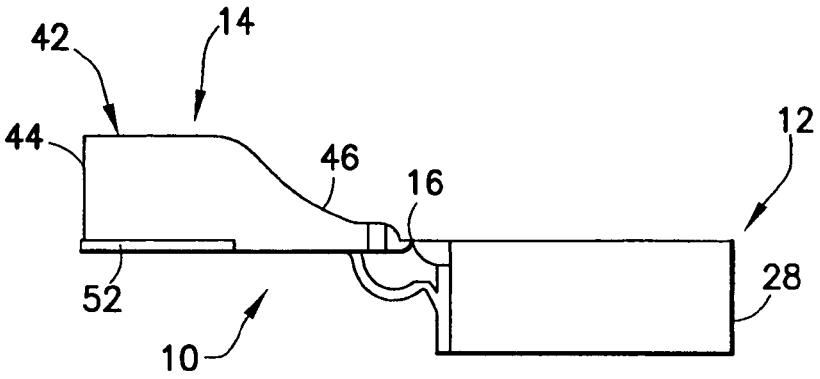
FIG. 4 is a side elevational view of the cap.

Body 12 further includes a substantially cylindrical outer wall 28 extending down from outer periphery 20 of top wall 18 and concentric with inner wall 24. Outer wall 28 has an array of internal threads 30 facing inwardly thereon, as shown in FIGS. 1 and 3.

Figure 2:
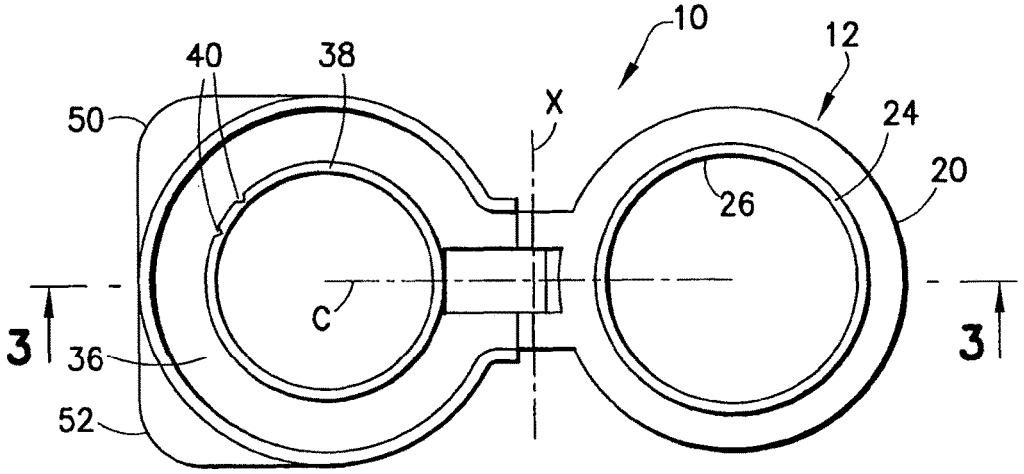
FIG. 2 is a top plan view of the cap shown in FIG. 1.

Lid 14 includes a substantially planar top wall 32 that is joined unitarily to top wall 18 of body 12 by hinge 16. Thus, top wall 32 of lid 14 can be rotated about a rotational axis "x" defined by hinge 16 and relative to top wall 18 of body 12. Top wall 32 of lid 14 has opposed inner and outer surfaces 34 and 36. Inner surface 36 faces up in the open position of lid 14 as shown in FIGS. 1-3. However, inner surface 36 of top wall 32 faces down and opposes top wall 18 of body 12 when lid 14 is in the closed position of FIGS. 5 and 6.

A substantially cylindrical skirt 38 extends perpendicularly from inner surface 36 of top wall 32 and is dimensioned for sealing engagement with sealing surface 26 of body 12 when lid 14 is rotated into the closed position of FIGS. 5 and 6. A plurality of anti-splash notches 40 are formed in the outer circumferential surface of skirt 38 along a side of skirt 38 substantially opposite hinge 16. Notches 40 extend from the edge of skirt 38 spaced from top wall 32 but terminate at locations spaced from inner surface 36 of top wall 32. Anti-splash notches 40 permit a flow of gas during early stages of movement of lid 14 from the closed position of FIGS. 5 and 6 towards the open position of FIGS. 1-4 to balance air pressure on opposite sides of cap 10 and to avoid a splashing or spraying of liquid that could otherwise occur with a very rapid change of air pressure.

Lid 14 further includes an outer wall 42 that projects perpendicularly from inner surface 36 of top wall 32 at a location spaced outwardly from skirt 38. Outer wall 42 is substantially cylindrically generated about a longitudinal axis that is perpendicular to and spaced from rotational axis "x" of hinge 16. Additionally, outer wall 42 defines an inside diameter that exceeds the outside diameter defined by top wall 18 and outer wall 28 of body 12. Thus, outer wall 42 of lid 14 can be telescoped partly over body 12. Outer wall 42 includes a shield 44 that extends through an arc on a side of outer wall 42 substantially opposite hinge 16. Shield 44 of outer wall 42 preferably extends through an arc of between 135° and 180°. In the illustrated embodiment, shield 44 of outer wall 42 extends through an arc of approximately 180°. Outer wall 42 further includes short sections 46 that extend from opposite circumferential ends of shield 44 towards hinge 16. The height reduction achieved through short sections 46 of outer wall 42 permit lid 14 to be rotated efficiently from the open position of FIGS. 1-4 to the closed position of FIGS. 5 and 6 without interference with body 12. In the preferred embodiment, shield 44 of outer wall 42 defines a height of between approximately 0.4-0.7 inch, and preferably about 0.54 inch.

Lid 14 further includes tabs 50 and 52 that extend outwardly from shield 44 substantially in the plane defined by top wall 32 of lid 42. Tabs 50 and 52 are disposed at locations on lid 14 spaced circumferentially from hinge 16. More particularly, each tab 50, 52 extends from a side location spaced circumferentially approximately 90° from a center line "c" that passes perpendicularly through rotational axis "x" at the center of hinge 16. Additionally, tabs 50 and 52 extend towards a distal location on top wall 32 substantially diametrically opposite the intersection of center line "c" and rotational axis "x" of hinge 16.

Each tab 50 and 52 has a shape substantially conforming to an isosceles right triangle that has a rounded right angle corner and a concave hypotenuse conforming to the outer circumferential surface of shield 44. The maximum radial extent of each tab 50 and 52 is disposed at a position spaced approximately 135° from the intersection of center line "c" and rotational axis "x" of hinge 16. The maximum extent of tabs 50, 52 from shield 44 is sufficient to provide a secure and convenient engagement surface for a thumb or forefinger during opening of lid 14 relative to body 12. Preferably the maximum extent of tabs 50 and 52 is in a range of 0.2-0.4 inch.

Cap 10 can be employed with a laboratory vessel, such as tube 60 illustrated in FIGS. 7-10. Tube 60 has a cylindrical side wall 62, a closed conically generated bottom wall 64 and an open top (not shown). Portions of side wall 62 adjacent the open top have an array of external threads dimensioned and configured for threaded engagement with internal threads 26 on body 12 of cap 10. Thus, outer wall 28 of body 12 surrounds portions of cylindrical side wall 62 of tube 60 adjacent the open top of tube 60. Additionally, top wall 18 of body 12 rests on the open top of tube 60 and inner wall 24 of body 12 telescopes into cylindrical side wall 62 at the open top of tube 60. Lid 14 generally is in the closed condition illustrated in FIGS. 7 and 8 for securely sealing the interior of tube 60 and maintaining sterility for the interior of tube 60 and any cell or tissue cultures stored therein. In this closed condition, inner surface 36 of top wall 32 of lid 14 engages against top wall 18 of body 10. Additionally, skirt 38 is telescoped into sealing engagement with sealing surface 26 defined by opening 22 in top wall 18 and inner wall 24.

The contents of tube 60 may have to be accessed periodically by a pipette or the like to either remove culture from tube 60 or to deposit additional growth medium into tube 60. For this purpose, a laboratory worker grips side wall 62 of tube 60 between the forefingers and palm of a hand so that the thumb of that hand faces upwardly toward cap 10. The thumb then is urged against tab 50 or 52 and lid 14 is pushed up and away from body 12. As a result, lid 14 begins to rotate about hinge 16 and out of engagement with body 12. Notches 40 move past sealing surface 26 of body 12 during the initial movement of lid 14 to balance pressure on opposite sides of cap 10 and to avoid splashing or spraying that could otherwise occur with a sudden change of pressure. The over-center design of hinge 16 initially will resist rotation of lid 14 from the closed position shown in FIGS. 7 and 8. However, the over-center design of hinge 16 then assists rotation beyond about 90°, and accelerates lid 14 into the fully open condition illustrated in FIGS. 9 and 10.

Tabs 50 and 52 are in offset positions relative to centerline "c" passing centrally through hinge 16 perpendicular to rotation axis "x". Hence, the thumb used to open lid 14 necessarily will be in an offset position and is not likely to pass directly over opening 22 in top wall 18 of body 12. Additionally, tabs 50 and 52 are spaced outwardly from shield 44. Accordingly, shield 44 will separate the thumb of the user from opening 22 in top wall 18 and from skirt 38 as the thumb moves for rotating lid 14 from the closed position of FIGS. 7 and 8 to the open position of FIGS. 9 and 10. Accordingly, the disposition of tabs 50 and 52 and the disposition of shield 44 cooperate to prevent digital contact with areas of body 12 near opening 22 and hence prevent contamination. Additionally, cap 10 remains securely connected to tube 60 in both the open and closed conditions of lid 14. Accordingly, there is no risk of a cap being placed improperly on a work surface while the contents of tube 60 are being accessed. Still further, cap 10 permits convenient one-handed opening and closing and allows the laboratory worker to use the other hand for manipulating a pipette or other access device.

Figure 7:
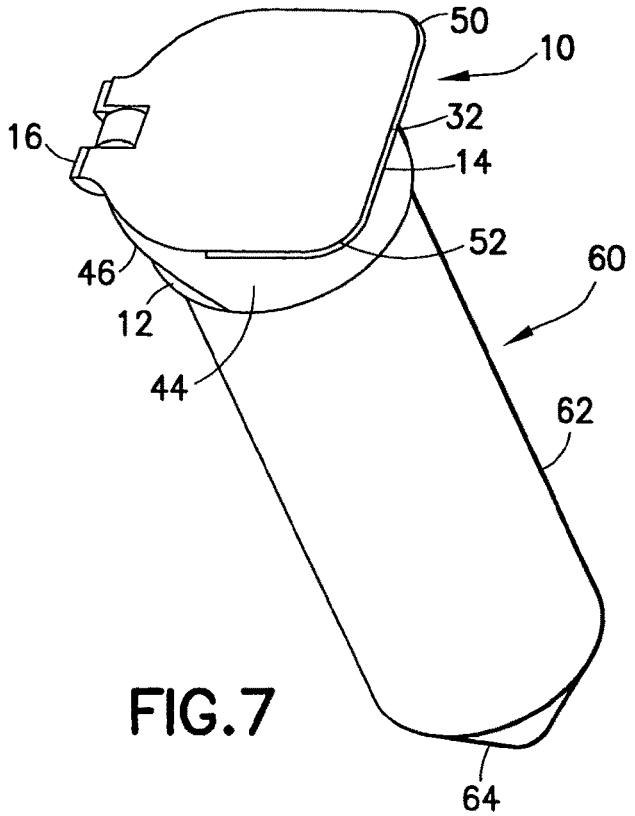
FIG. 7 is a perspective view of the closed cap mounted to a tube and showing the cap from the top side.
Figure 8:
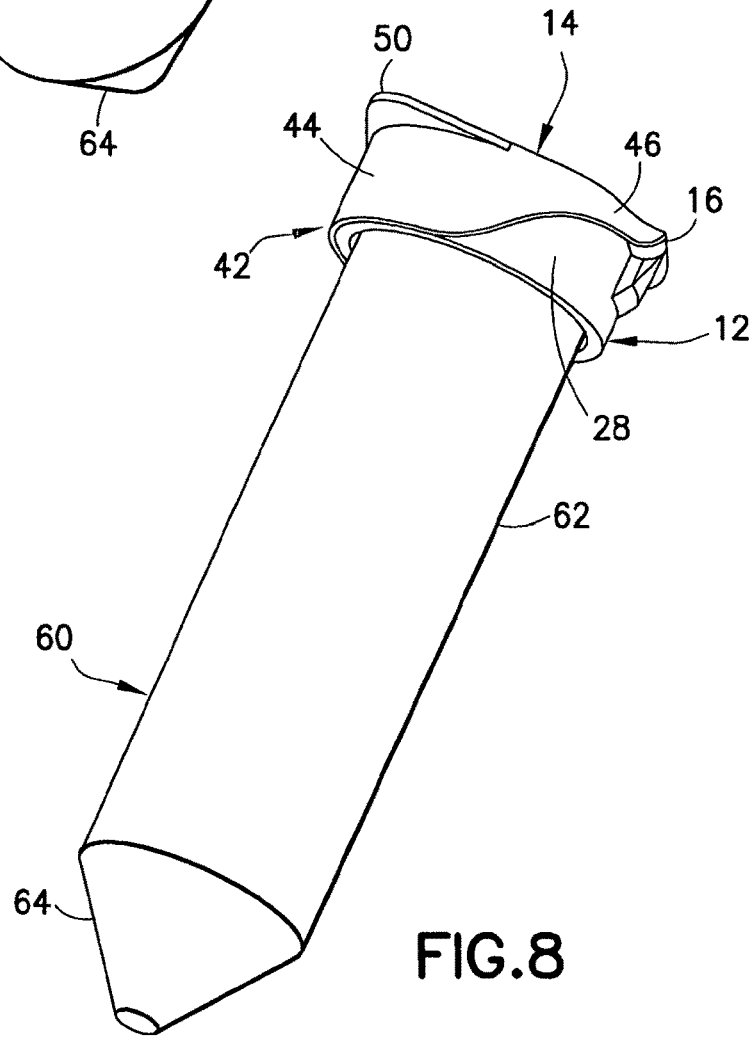
FIG. 8 is a perspective view of the closed cap mounted to a tube and showing the lower side of the cap.
Figure 9:
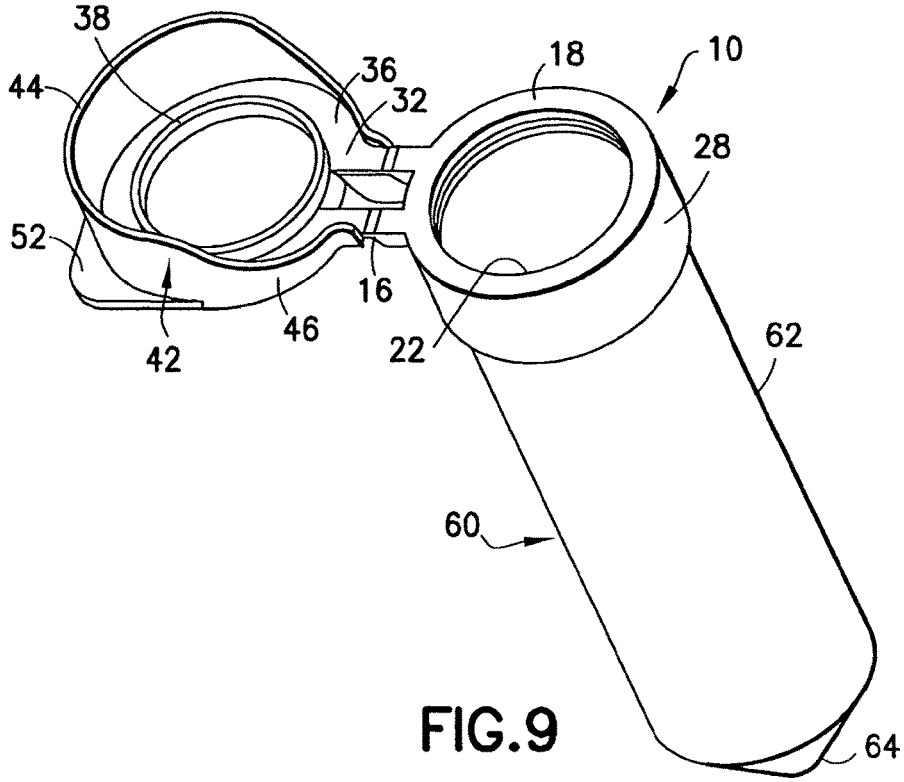
FIG. 9 is a first perspective view of the open cap mounted to the tube.
Figure 10:
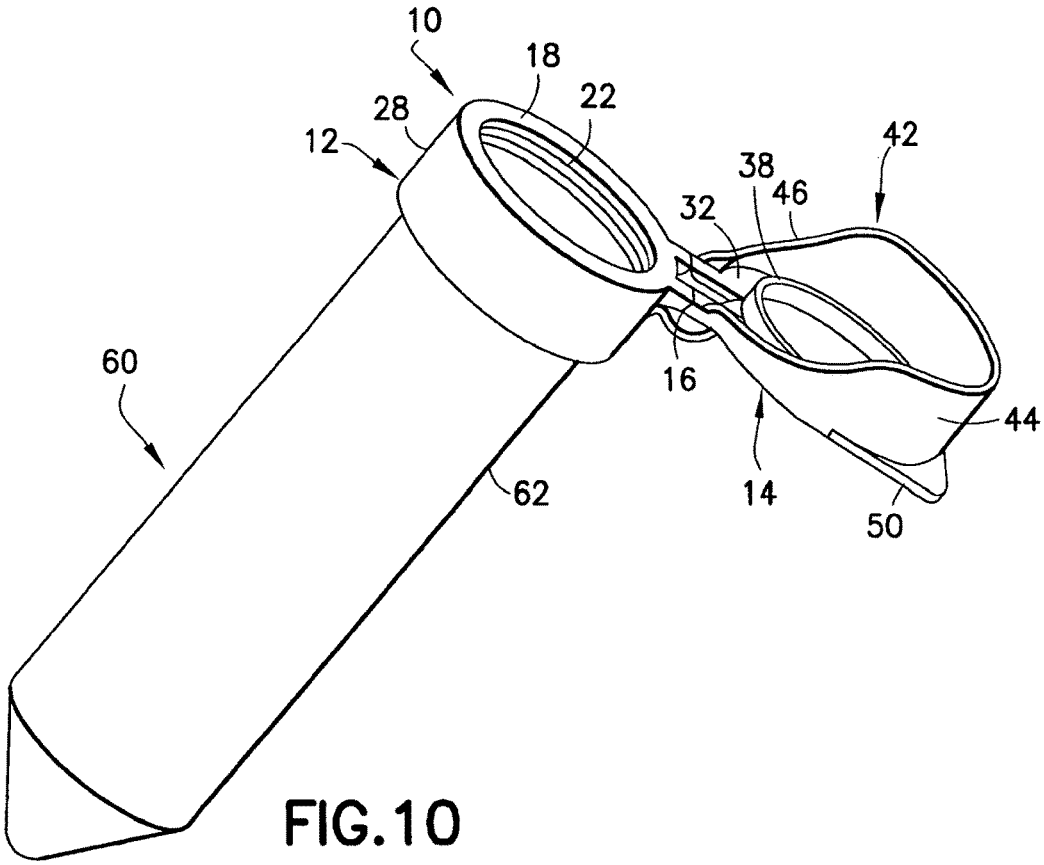
FIG. 10 is a second perspective view of the open cap mounted to the tube.

Lid 14 can be rotated from the open position in FIGS. 9 and 10 back to the closed position of FIGS. 7 and 8 after the interior of tube 62 is accessed. The shortening of outer wall 42 along sections 46 nearer hinge 16 enables lid 14 to be rotated into the closed position without interference with any part of body 12. Furthermore, the user inherently will engage portions of tabs 50 and 52 aligned with outer surface 34 of top wall 32 for moving lid 14 to the closed position of FIGS. 7 and 8. Hence, contamination with opening 22 is prevented during closing.

The invention has been described with respect to a preferred embodiment. However, changes can be made without departing from the scope of the invention defined by the appended claims. For example, the lid may be formed unitarily with the tube or other such vessel. This design option will avoid the need for providing a cap with a body that is hingedly attached to the tube or other vessel.

The lid 14 can be provided with only one of the tabs 50 and 52.

The tabs 50 and 52 can be disposed in an even more offset disposition and spaced further from the center line "c" passing perpendicularly through the rotational axis "x" defined by the hinge 16.

The hinge 16 need not be a living hinge and need not be of over-center design. For example, a hinge with plural parts snapped or otherwise connected can be provided.

What is claimed is:

1. A method of using a container, comprising the following steps:

(a) grasping a laboratory vessel comprising a cylindrical side wall and an open top, wherein the laboratory vessel is engaged with a cap, and wherein the cap comprises:

(1) a cap body comprising a side wall and a top wall, wherein the side wall has an inner surface and an outer surface and wherein the inner surface of the side wall comprises threaded features, wherein the top wall has an inner surface and an outer surface, the outer surface of the top wall of the cap body comprising a sealing surface, and wherein the top wall of the cap body defines an opening;

(2) a flip-top lid hingedly connected to the cap body, wherein the flip top lid is rotatable about an axis of rotation relative to said cap body between a closed position and an open position defined by a hinge, the flip-top lid comprising:

(i) a lid top wall having an inner surface and an outer surface, and (ii) a shield having an inner surface and an outer surface and comprising at least one rib extending outwardly from the outer surface, wherein a skirt extends from the inner surface of the lid top wall, the skirt dimensioned to telescope into the opening defined by the top wall of the cap body when the flip-top lid is in a closed position, and wherein the shield at least partially covers the side wall of the cap body when the flip-top lid is in a closed position;

wherein portions of the cylindrical side wall of the laboratory vessel adjacent to the open top of the laboratory vessel comprise an array of external threads configured for threaded engagement with the threaded features on the inner surface of the side wall of the cap body; and (b) with the flip-top lid in the closed position, applying pressure to the at least one rib to flip open the flip-top lid.

2. The method of claim 1 wherein the inner surface of the lid top wall engages with the sealing surface of the cap body when the flip-top lid is in a closed position.

3. The method of claim 1 wherein the inner surface of the side wall of the cap body engages with the outer surface of skirt when the flip-top lid is in a closed position.

4. The method of claim 1 wherein the flip-top lid is hingedly connected to the outer surface of the side wall of cap body.

5. The method of claim 4 wherein the inner surface of the lid top wall engages with the sealing surface of the cap body when the flip-top lid is in a closed position.

6. The method of claim 4 wherein the inner surface of the side wall of the cap body engages with the outer surface of skirt when the flip-top lid is in a closed position.

7. The method of claim 1 wherein the at least one rib comprises a protrusion extending along a circumferential portion of the outer surface of the shield.

8. The method of claim 7 wherein the inner surface of the side wall of the cap body engages with the outer surface of skirt when the flip-top lid is in a closed position.

9. The method of claim 7 wherein the inner surface of the lid top wall engages with the sealing surface of the cap body when the flip-top lid is in a closed position.

10. The method of claim 7 wherein the flip-top lid is hingedly connected to the top surface of the side wall of the cap body.

11. The method of claim 10 wherein the inner surface of the lid top wall engages with the sealing surface of the cap body when the flip-top lid is in a closed position.

12. The method of claim 10 wherein the inner surface of the side wall of the cap body engages with the outer surface of skirt when the flip-top lid is in a closed position.

13. A method of using a container, comprising the following steps:

(a) grasping a laboratory vessel comprising a cylindrical side wall and an open top, wherein the laboratory vessel is engaged with a cap, and wherein the cap comprises:

(1) a cap body comprising a side wall and a top wall, wherein the side wall has an inner surface and an outer surface and wherein the inner surface of the side wall comprises threaded features, wherein the top wall has an inner surface and an outer surface, the outer surface of the top wall of the cap body comprising a sealing surface, and wherein the top wall of the cap body defines an opening;

(2) a flip-top lid hingedly connected to the cap body, wherein the flip top lid is rotatable about an axis of rotation relative to said cap body between a closed position and an open position defined by a hinge, the flip-top lid comprising:

(i) a lid top wall having an inner surface and an outer surface, (ii) a shield having an inner surface and an outer surface, and (iii) at least one tab extending outwardly from the outer surface of the shield, wherein a skirt extends from the inner surface of the lid top wall, the skirt dimensioned to telescope into the opening defined by the top wall of the cap body when the flip-top lid is in a closed position, and wherein the shield at least partially covers the side wall of the cap body when the flip-top lid is in a closed position;

wherein portions of the cylindrical side wall of the laboratory vessel adjacent to the open top of the laboratory vessel comprise an array of external threads configured for threaded engagement with the threaded features on the inner surface of the side wall of the cap body; and (b) with the flip-top lid in the closed position, applying pressure to the at least one rib to flip open the flip-top lid.

14. The method of claim 13 wherein the inner surface of the lid top wall engages with the sealing surface of the cap body when the flip-top lid is in a closed position.

15. The cap of claim 13 wherein the inner surface of the side wall of the cap body engages with the outer surface of the skirt when the flip-top lid is in a closed position.

* * * * *